US007325312B1

(12) United States Patent
Janich

(10) Patent No.: US 7,325,312 B1
(45) Date of Patent: Feb. 5, 2008

(54) FOLDING KNIFE WITH PIVOTING BLADE AND GUARD

(75) Inventor: Michael D. Janich, Longmont, CO (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 0 days.

(21) Appl. No.: 11/636,066

(22) Filed: Dec. 8, 2006

(51) Int. Cl.

| | |
|---|---|
| ***B26B 3/06*** | (2006.01) |
| ***B26B 11/00*** | (2006.01) |
| ***F41B 13/02*** | (2006.01) |
| ***F41C 27/18*** | (2006.01) |

(52) U.S. Cl. ..... 30/161; 30/153; 30/160; 30/155; 7/118

(58) Field of Classification Search ..... 30/11–155, 30/157, 158, 160, 161, 164; 7/118, 168
See application file for complete search history.

(56) References Cited

U.S. PATENT DOCUMENTS

| | | | | | |
|---|---|---|---|---|---|
| 226,910 | A | * | 4/1880 | Friebertshauser | 30/161 |
| 229,706 | A | | 7/1880 | Jansen | |
| 273,981 | A | | 3/1883 | Glover | |
| 338,251 | A | * | 3/1886 | Crandall et al. | 30/161 |
| 357,353 | A | * | 2/1887 | Wiesner | 30/160 |
| 470,777 | A | | 3/1892 | Billings | |
| 488,340 | A | | 12/1892 | Skoglund | |
| 749,230 | A | * | 1/1904 | Severance | 30/160 |
| 881,294 | A | | 3/1908 | Billings | |
| 1,259,603 | A | | 3/1918 | Conord | |
| 1,350,251 | A | | 8/1920 | Armour | |
| 1,353,490 | A | | 9/1920 | Pantalek | |
| 1,659,418 | A | | 2/1928 | Werner | |
| 1,665,955 | A | | 4/1928 | Gatewood | |
| 1,994,215 | A | | 3/1935 | Gaunt | |
| 2,199,430 | A | | 5/1940 | Greve | |
| 2,714,249 | A | | 8/1955 | Clark et al. | |
| 3,702,501 | A | * | 11/1972 | Wood | 30/153 |
| 4,133,106 | A | * | 1/1979 | Addis | 30/160 |
| D424,398 | S | | 5/2000 | Zaha | |
| 6,170,158 | B1 | | 1/2001 | Daily | |

* cited by examiner

*Primary Examiner*—Joseph J. Hail, III
*Assistant Examiner*—Bryan R. Muller
(74) *Attorney, Agent, or Firm*—Bowman Green Hampton & Kelly, PLLC

(57) ABSTRACT

A folding knife having a handle, a pivoting blade guard, and a pivoting blade. Both the guard and the blade pivot on a common pivot pin that is secured to or within the handle. Both the handle and the guard feature at least one arcuate slot that extends in an arc around the pivot pin. A tang pin located in the tang of the blade rides in the arcuate slots and serves as a stop for both the handle and the guard, limiting the range of their rotation on the pivot pin.

22 Claims, 7 Drawing Sheets

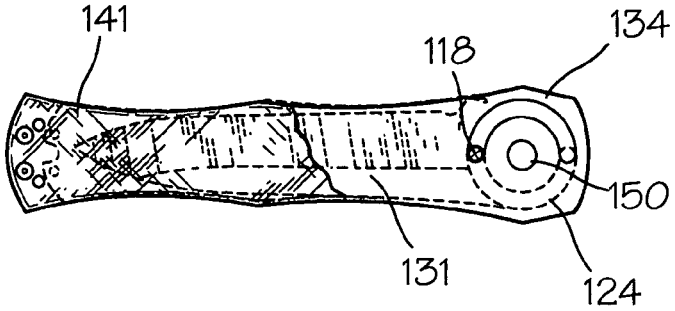
Fig. 7A
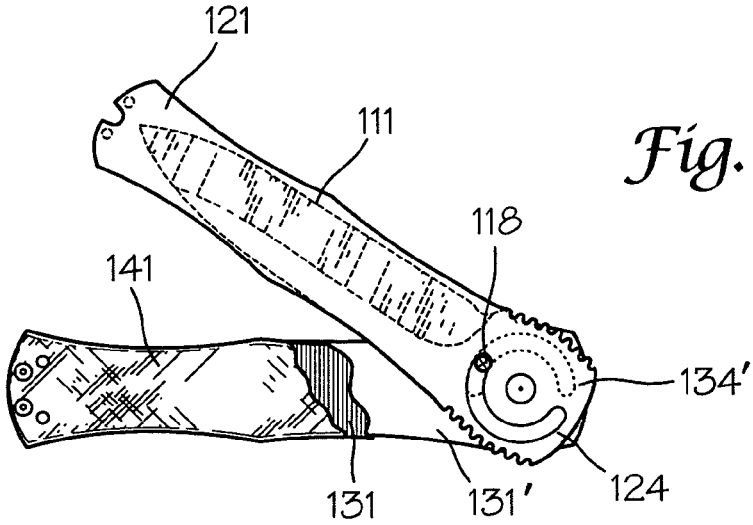
Fig. 7B
Fig. 7C
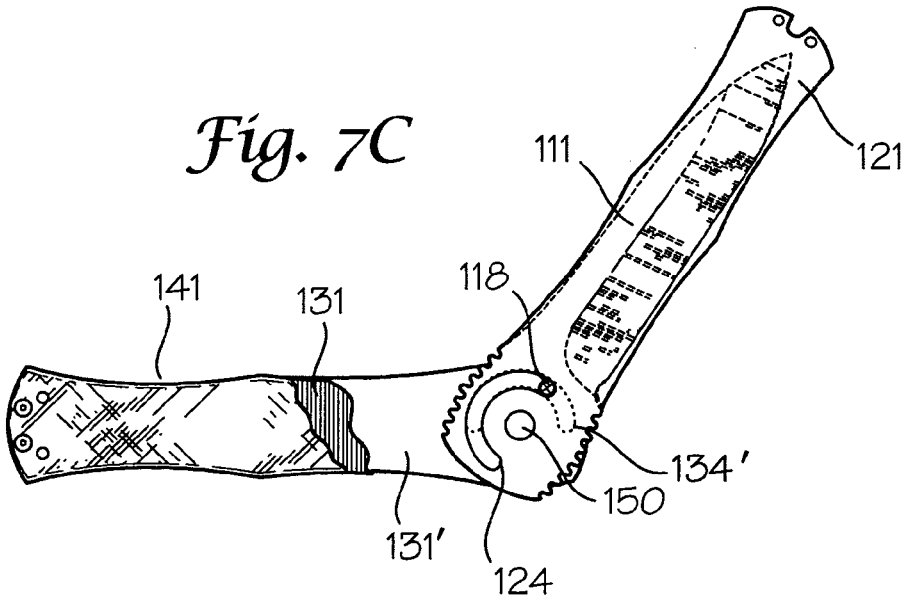

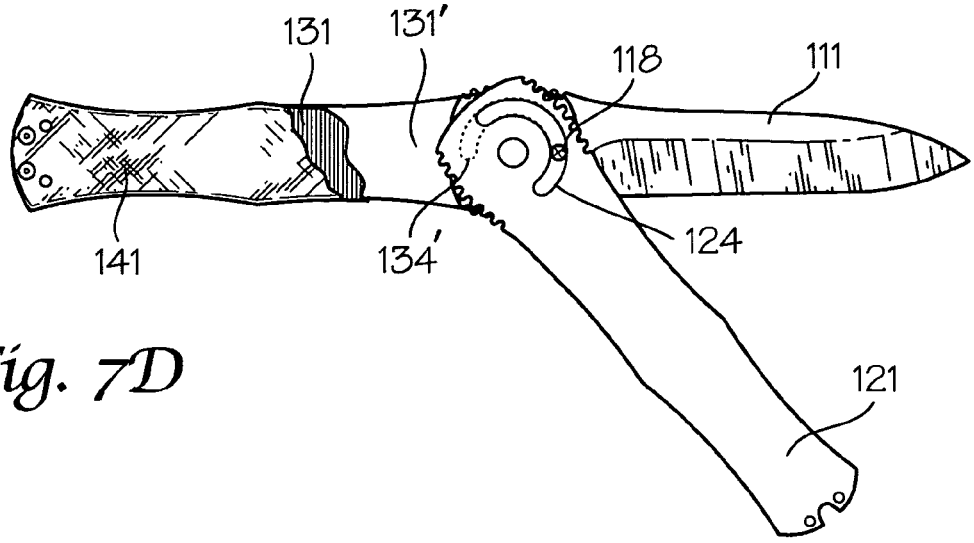
Fig. 7D
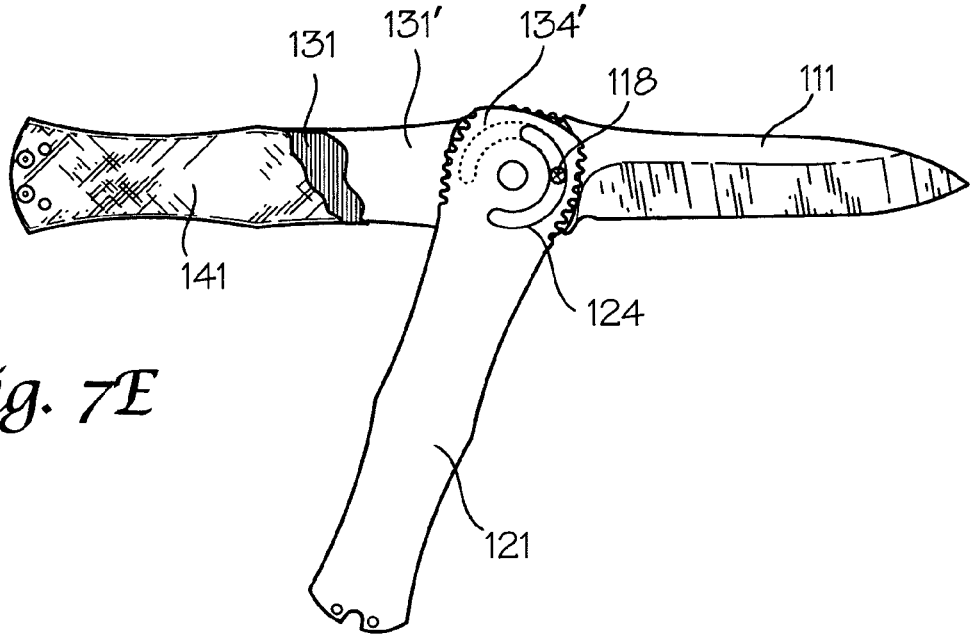
Fig. 7E
Fig. 7F
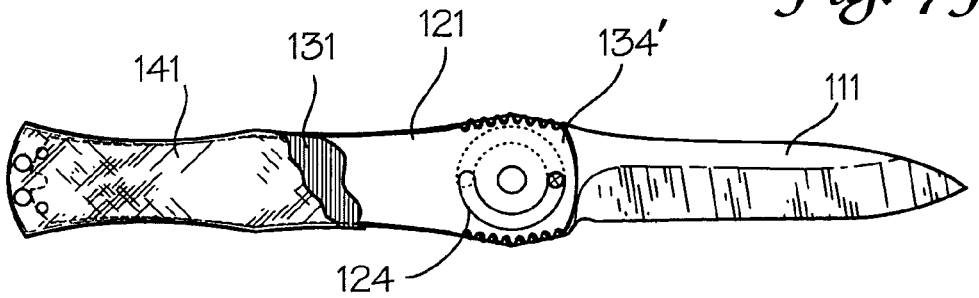

FOLDING KNIFE WITH PIVOTING BLADE AND GUARD

BACKGROUND OF THE INVENTION

1. Field of the Invention

The present invention is directed generally to a folding knife. More specifically, the present invention is directed to a folding knife having a pivoting blade and a pivoting blade guard.

2. Description of Related Art

Typically, folding knives are knifes with at least one blade that is pivotably connected to a single handle. The blade generally pivots 180° between a closed position, wherein the blade is located within a groove in the handle, and an opened position, wherein the blade typically extends from the handle.

A Balison, sometimes called a Butterfly knife or a Batangas knife, is a type of folding knife that includes a single blade pivotably connected to two handle halves. The handle halves each rotate around the blade such that, when closed, the blade is concealed within grooves in the handle halves, and when opened, the blade extends from both of the handle halves. Because of the construction of the Balisong, the Balisong can quickly be manipulated, or flipped, from a closed to an opened position using one hand.

SUMMARY OF THE INVENTION

However, in the case of both the traditional folding knife and the Balisong, as the blade transitions between a closed position and an opened position, the blade is exposed and can cause injury to the user. Likewise, when the blade transitions between an opened position and a closed position, the blade is again exposed.

This invention relates generally to a folding knife. More specifically, the present invention is directed to a folding knife having a pivoting blade and a pivoting blade guard. In various exemplary embodiments, the folding knife of this invention comprises at least some of a handle, a guard, and a blade.

Both the guard and the blade pivot on a common pivot pin that is secured to or within the handle. Both the handle and the guard feature at least one arcuate slot that extends in an arc around the pivot pin. A tang pin that is located in the tang of the blade rides in the arcuate slots and serves as a stop for both the handle and the guard, limiting the range of their rotation on the pivot pin.

In the closed position, the guard and blade are nested within the handle. To open the folding knife, the guard and blade are rotated together out of the handle. As this occurs, the tang pin travels in the handle's arcuate slot until it reaches the end of the slot, where it stops and restricts the blade from rotating further. At this point, the guard continues to pivot. As the guard continues to pivot, the guard's arcuate slot travels around the now stationary tang pin.

At the completion of the guard's arc, the guard's travel is stopped by the stationary tang pin interacting with the end of the guard's slot. The tang pin is now locked between the two opposing ends of the arcuate handle slot and the arcuate guard slot. This action locks the blade securely in place. The completion of the guard's arc also leaves the guard nested within the handle, presenting a single handle unit as a purchase for using the folding knife. The natural grasp of the hand keeps the handle and guard together and secures the locking action of the blade.

Reversing this process closes both the guard and the blade safely within the handle.

If desired, the guard and handle may be held together in a fully open or fully closed position by means of a spring detent, magnets, or other device. A thumb stud, finger button, or similar purchase point may also be added to the guard to allow easier initiation of the opening process.

If constructed of materials of sufficient mass, this design could be quickly and easily manipulated with one hand opening and closing techniques similar to those employed in the use of a Balisong.

Accordingly, this invention provides a folding knife, which allows the blade to generally remain protected within a guard as the blade is moving to the opened position.

This invention separately provides a folding knife, which allows the blade to generally remain protected within a guard as the blade is moving to the closed position.

This invention separately provides a folding knife, which is easily opened or closed with one hand.

This invention separately provides a folding knife lock means, which can be easily engaged and disengaged.

This invention separately provides a folding knife, which, when in the opened position and grasped in a normal, working manner, locks the blade such that the blade cannot be closed on the user's fingers.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein:

FIG. 7A shows a partially-cutaway side view of the first exemplary embodiment of the folding knife according to this invention, illustrating the knife in the closed position;

FIG. 7B shows a partially-cutaway side view of the first exemplary embodiment of the folding knife according to this invention, illustrating the knife in a first exemplary position in the opening sequence;

FIG. 7C shows a partially-cutaway side view of the first exemplary embodiment of the folding knife according to this invention, illustrating the knife in a second exemplary position in the opening sequence;

FIG. 7D shows a partially-cutaway side view of the first exemplary embodiment of the folding knife according to this invention, illustrating the knife in a third exemplary position in the opening sequence;

FIG. 7E shows a partially-cutaway side view of the first exemplary embodiment of the folding knife according to this invention, illustrating the knife in a fourth exemplary position in the opening sequence; and FIG. 7F shows a partially-cutaway side view of the first exemplary embodiment of the folding knife according to this invention, illustrating the knife in the opened position.

DETAILED DESCRIPTION OF EXEMPLARY EMBODIMENTS

For simplicity and clarification, the design factors and operating principles of the folding knife according to this invention are explained with reference to various exemplary embodiments of the folding knife according to this invention. The basic explanation of the design factors and operating principles of the folding knife of this invention is applicable for the understanding, design, and operation of the folding knife of this invention.

It should also be appreciated that the term "knife" is used for basic explanation and understanding of the operation of the systems, methods, and apparatuses of this invention. Therefore, the term "knife" is not to be construed as limiting the systems, methods, apparatuses, or applications of this invention.

It should also be appreciated that while this invention is described and shown as a folding knife having a knife blade and knife blade guard that rotate with respect to a handle, in various exemplary, contemplated embodiments, the knife blade may be replaced by another instrument, implement, or tool portion having a working portion, such as, for example, screwdriver, a pen, pencil, or other marking device, one or more keys, a saw blade, or any other instrument, implement, or tool, while still employing the design factors and operating principles of this invention, thus forming a folding implement.

Figure 1:
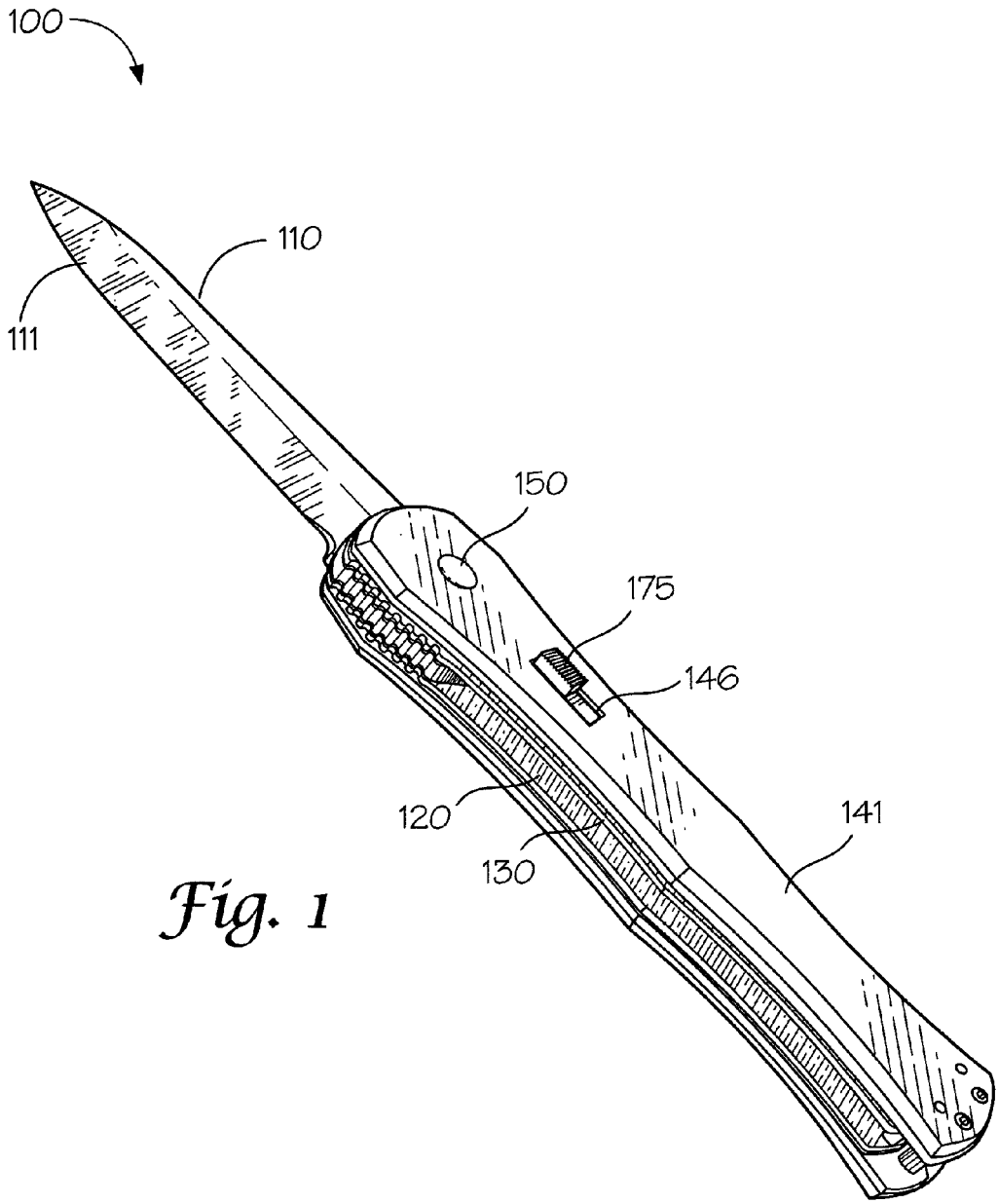
FIG. 1 shows a perspective view of an exemplary embodiment of a folding knife having a pivoting blade and a pivoting blade guard, according to this indenting, illustrating the knife in the opened position.
Figure 2:
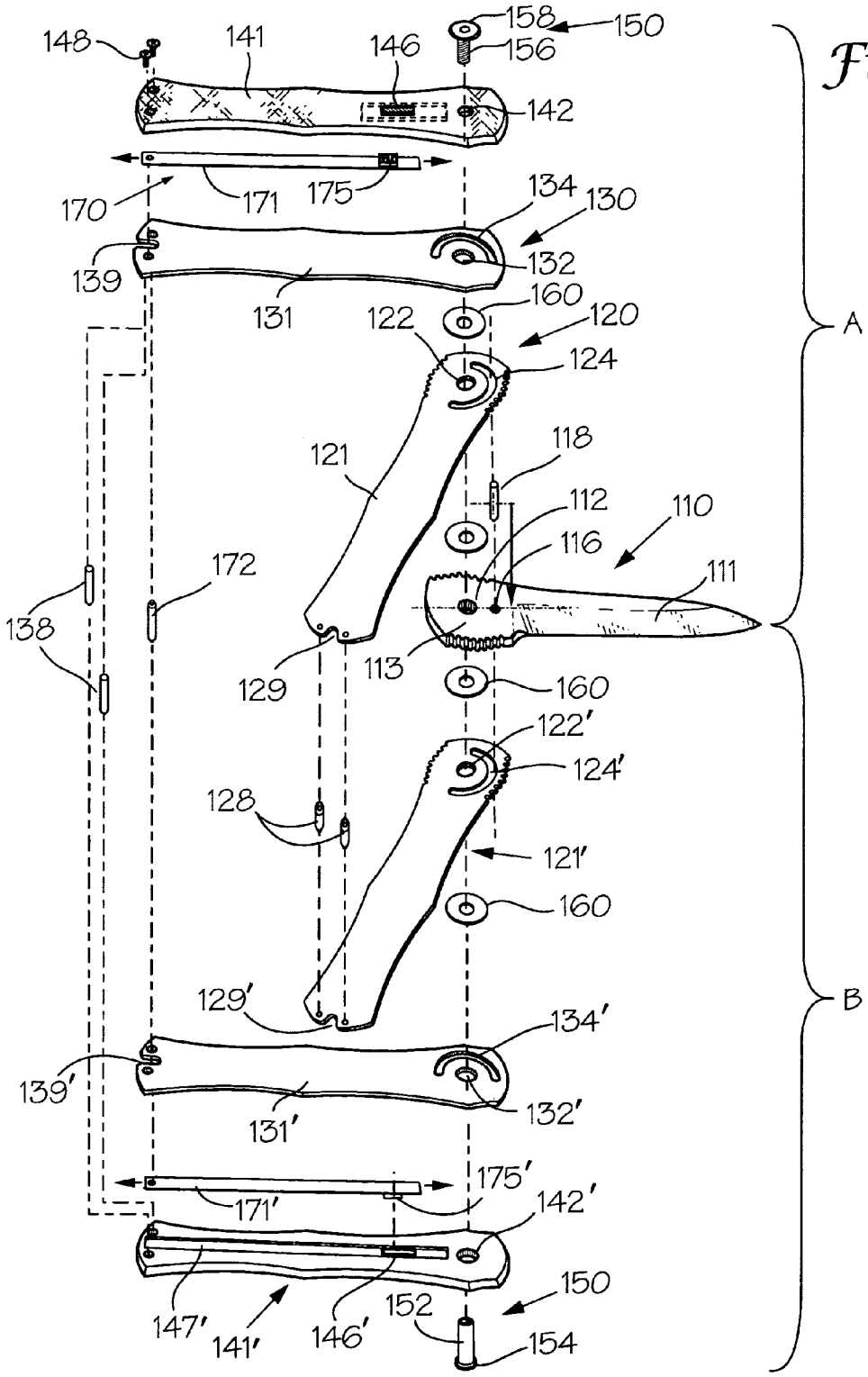
FIG. 2 shows an exploded perspective view of a first exemplary embodiment of the folding knife according to this invention.
Figure 3A:
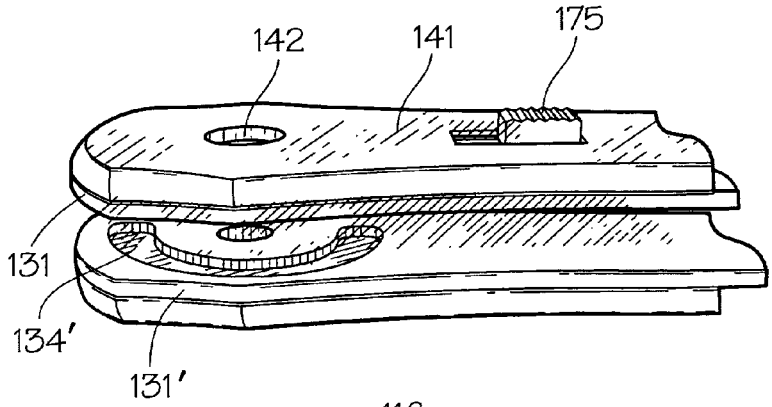
FIG. 3A shows a more detailed perspective view of a portion of the knife handles of the first exemplary embodiment of the folding knife according to this invention.
Figure 3B:
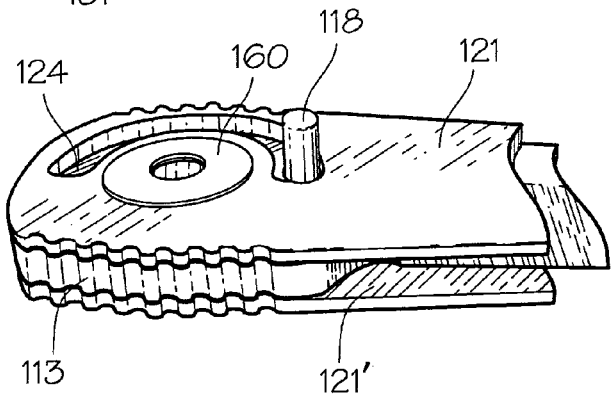
FIG. 3B shows a more detailed perspective view of a portion of the knife blade and guard of the first exemplary embodiment of the folding knife according to this invention.
Figure 4:
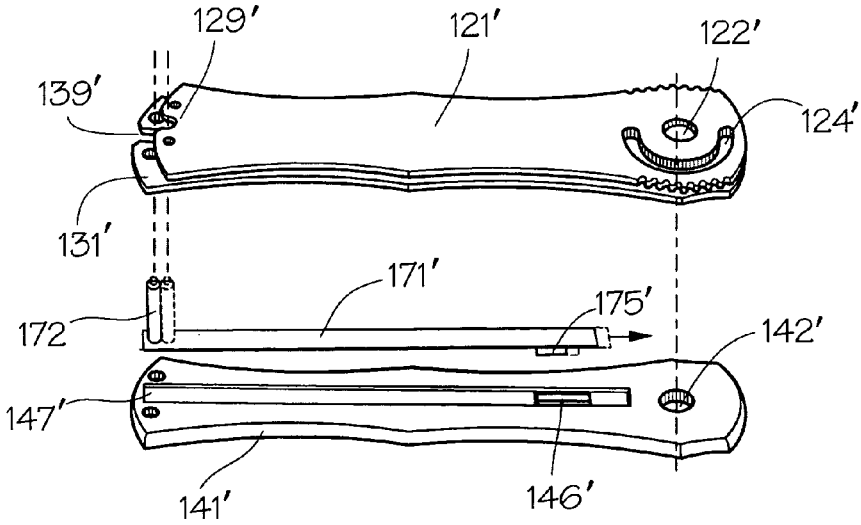
FIG. 4 shows a partial exploded side elevation view, illustrating the handle, scale, and locking means of the first exemplary embodiment of the folding knife according to this invention.

Turning now to the drawings FIGS. as illustrated in FIGS. 1 and 2, the exemplary folding knife 100 comprises at least some of a blade 110, a guard 120, a handle 130, and handle scales 141 and 141'. In various exemplary, non-limiting embodiments, the folding knife 100 may also include a lock means 170.

As illustrated in FIG. 2, the blade 110 includes a sharpened portion 111 and a tang portion 113. In various exemplary embodiments, the sharpened portion 111 may include one or more cutting edges and may terminate in an edge or point. The cutting edge(s) may include serrated portions. Alternatively, the sharpened portion 111 may not be sharpened such that the folding knife 100 may be used as a training or practice knife.

A blade pivot pin aperture 112 and a blade tang pin aperture 116 are formed in the tang portion 113 of the blade 110. The blade pivot pin aperture 112 is sized to allow the blade 110 to pivot around a sleeve portion 152 of a pivot pin 150. The blade tang pin aperture 116 is formed to accept a tang pin 118.

The guard 120 comprises a first guard plate 121 and a second guard plate 121'. In various exemplary embodiments, the first guard plate 121 and the second guard plate 121' have identical or substantially identical shaping and dimensioning and are substantially identical in planform. The first guard plate 121 includes a guard pivot pin aperture 122 formed proximate a pivot end of the first guard plate 121. The guard pivot pin aperture 122 is sized to allow the first guard plate 121 to pivot around the sleeve portion 152 of the pivot pin 150.

An arcuate guard slot 124 is formed in the first guard plate 121, concentric to the guard pivot pin aperture 122, and positioned to be aligned with the blade tang pin aperture 116.

In various exemplary embodiments, the second guard plate 121' also includes a guard pivot pin aperture 122' formed proximate a pivot end of the second guard plate 121'. As with the guard pivot pin aperture 122, the guard pivot pin aperture 122' is sized to allow the second guard plate 121' to pivot around the pivot pin 150.

An arcuate guard slot 124' is formed in the second guard plate 121', concentric to the guard pivot pin aperture 122', and positioned to be aligned with the blade tang pin aperture 116.

The first guard plate 121 and the second guard plate 121' are coupled together, proximate a free end of the first guard plate 121 and the second guard plate 121', via guard coupling means 128, to form the generally "U" shaped guard 120. In various exemplary embodiments, the guard coupling means 128 comprise one or more rivets that are used to join the first guard plate 121 and the second guard plate 121'. However, it should be appreciated that, in various exemplary embodiments, the guard coupling means 128 may comprise screws, welded bars, bars coupled by adhesives, or any other means for permanently or releasably coupling or joining the first guard plate 121 to the second guard plate 121'. Alternatively, the guard 120 may be formed as one continuous component, wherein the first guard plate 121, the coupling means 128, and the second guard plate 121' are formed as one unit or component.

When the first guard plate 121 and the second guard plate 121' are coupled together, if necessary, the first guard plate 121 and the second guard plate 121' are substantially parallel and spaced apart to define a blade storage area between the first guard plate 121 and the second guard plate 121'. The blade storage area is appropriately sized to allow at least the sharpened portion 111 of the blade 110 to be pivoted into and/or out of the blade storage area.

The handle 130 comprises a first handle plate 131 and a second handle plate 131'. In various exemplary embodiments, the first handle plate 131 and the second handle plate 131' have identical or substantially identical shaping and dimensioning and are substantially identical in planform. The first handl plate 131 includes a handle pivot pin aperture 132 formed proximate a pivot end of the first handle plate 131. The handle pivot pin aperture 132 is sized to accept the sleeve portion 152, or any other appropriate portion, of the pivot pin 150.

An arcuate handle slot 134 is formed in the first handle plate 131, concentric to the handle pivot pin aperture 132, and positioned to be aligned with the blade tang pin aperture 116.

In various exemplary embodiments, the second handle plate 131' also includes a handle pivot pin aperture 132' formed proximate a pivot end of the second handle plate 131'. As with the handle pivot pin aperture 132, the handle pivot pin aperture 132' is sized to accept the sleeve portion 152, or any other appropriate portion, of the pivot pin 150.

An arcuate handle slot 134' is formed in the second handle plate 131', concentric to the handle pivot pin aperture 132', and positioned to be aligned with the blade tang pin aperture 116.

The first handle plate 131 and the second handle plate 131' are coupled together, proximate a free end of the first handle plate 131 and the second handle plate 131', via handle coupling means 138, to form the generally "U" shaped handle 130. In various exemplary embodiments, the handle coupling means 138 comprise one or more rivets that are used to join the first handle plate 131 and the second handle plate 131'. However, it should be appreciated that, in various exemplary embodiments, the handle coupling means 138 may comprise screws, welded bars, bars held by an adhesive, or any other means for permanently or releasably coupling or joining the first handle plate 131 to the second handle plate 131'. Alternatively, the handle 130 may be formed as one continuous component, wherein the first handle plate 131, the coupling means 138, and the second handle plate 131' are formed as one unit or component. In still other exemplary embodiments, one or more of the first handle plate 131 and the second handle plate 131' may be skeletonized or comprise a more cylindrical profile.

When the first handle plate 131 and the second handle plate 131' are coupled together, if necessary, the first handle plate 131 and the second handle plate 131' are substantially parallel and spaced apart to define a guard storage area between the first handle plate 131 and the second handle plate 131'. The guard storage area is appropriately sized to allow the guard 120 to be pivoted into and/or out of the guard storage area.

To form the folding knife 100, the guard 120 is positioned within the guard storage area of the handle 130 and the blade 110 is positioned within the blade storage area of the guard 120 such that the blade pivot pin aperture 112, the guard pivot pin apertures 122 and 122', and the handle pivot pin apertures 132 and 132' are aligned.

When the guard 120, the handle 130, and the blade 110 are appropriately aligned, the tang pin 118 is positioned within the aligned arcuate handle slots 134 and 134', the aligned arcuate guard slots 124 and 124', and the aligned blade tang pin aperture 116. In this manner, the angular rotation of the guard 120 and the blade 110, in relation to the handle 130, are restricted to the degree of angular rotation allowed by the respective arcuate slots.

When the tang pin 118 is positioned, the handle scales 141 and 141' are coupled in overlying relationship with an outer surface of the first handle plate 131 and the second handle plate 131', respectively. In various exemplary embodiments, the handle scales 141 and 141' have identical or substantially identical shaping and dimensioning and are substantially identical in planform to the first handle plate 131 and the second handle plate 131', respectively.

In various exemplary embodiments, the handle scales 141 and 141' each include a scale pivot pin aperture 142 and 142', formed to align with the handle pivot pin apertures 132 and 132', respectively. In various exemplary embodiments, the scale pivot pin apertures 142 and 142' are sized to accept the sleeve portion 152, or any other appropriate portion, of the pivot pin 150. Alternatively, the scale pivot pin apertures 142 and 142' may each be sized to accept at least a portion of the enlarged head portion 154 or 156 of the pivot pin 150 so that the enlarged head portions 154 and 156 may be recessed or partially recessed within at least a portion of the handle scales 141 and 141'.

In various exemplary embodiments, the handle scales 141 and 141' may be formed of G-10, a plastic, a metal, a composite, or any other suitable material. In still other exemplary embodiments, one or more of the handle scales 141 and 141' may be skeletonized or comprise a more cylindrical profile.

The handle scales 141 and 141' may be attached, coupled, or joined to the handle plates 131 and 131', via, for example, scale attachment means 148. In various exemplary embodiments, as shown herein, a scale attachment means 148 may comprise one or more bolts that are used to join the first handle scale 141 to the first handle plate 131 and the second handle scale 141' to the second handle plate 131'. Alternatively, the handle scales 141 and 141' may be attached or coupled to the handle plate 131 and 131', via rivets, screws, adhesives, welding, or any other means of methods for permanently or releasably attaching, coupling, or joining the handle scales 141 and 141' to the handle plates 131 and 131'.

In various exemplary embodiments, the handle scales 141 and 141' are attached, coupled, or joined to the handle plates 131 and 131' in order to, among other things, maintain the tang pin 118 in place. However, in various alternative embodiments, the arcuate handle slot 134 and the arcuate handle slot 134' may be formed up mere recesses and the first handle plate 131 and the second handle plate 131', which do not extend completely through the handle plates 131 and 131'. In these embodiments, the tang pin 118 may be maintained in place by the handle plates 131 and 131' and the handle scales 141 and 141' may be optional.

As illustrated herein, the tang pin 118 comprises a pin or rod that is removable positioned within the blade tang pin aperture 116. Alternatively, the tang and 118 may be secured within the blade tang and aperture 116. In still other embodiments, the tang pin 118 may comprise one or more appropriately sized protrusions that extend from the tang portion 113 of the blade 110. In these exemplary embodiments, the tang pin 118 is formed as an integral part of the blade 110.

To maintain the blade 110, the guard 120, the handle 130, and the handle scales 141 and 141', if included, in an appropriately assembled relationship, the pivot pin 150 is extended through the aligned blade pivot pin aperture 112, guard pivot pin apertures 122 and 122', handle pivot pin apertures 132 and 132', and scale pivot pin apertures 142 and 142' and secured in place.

In various exemplary embodiments, as shown herein, the pivot pin 150 includes two components, an internally threaded sleeve portion 152 having an enlarged head portion 154, and an externally threaded bolt portion 156, also having an enlarged head portion 158. The blade pivot pin aperture 112, the guard pivot pin apertures 122 and 122', and the handle pivot pin apertures 132 and 132' are all sized to accept the sleeve portion 152, or any other appropriate portion, of the pivot pin 150. While the handle pivot pin apertures 132 and 132' may be sized to accept the sleeve portion 152, or any other appropriate portion, of the pivot pin 150 in a relatively tight, friction fit, the blade pivot pin aperture 112 and the guard pivot pin apertures 122 and 122' are sized to allow the blade 110 and the guard 120 to pivot relatively freely, about the sleeve portion 152 of the pivot pin 150.

Generally, the bolt portion 156 of the pivot pin 150 is shorter than the internally threaded portion of the sleeve portion 152, such that the bolt portion 156 can be threaded into the sleeve portion 152 until a free end of the sleeve portion 152 contacts the underside of the head portion 158 of the bolt portion 156. In this manner, the amount of compression between the handle 130, the guard 120, and blade 110 can be limited by the length of the sleeve portion 152 of the pivot pin 150.

While a specific version of the pivot pin 150 is described and shown herein, it should be appreciated that the pivot pin 150 may be replaced by, for example a rivet, bushing, rolling pin, bearing, or any other known or later developed device capable of securing the handle 130, the guard 120, and blade 110 together while allowing the guard 120 in the blade 110 to pivot as described herein. In certain exemplary embodiments, the pivot pin 150 may have a larger diameter portion, for example, in the area of one or both of the blade 110 and the first guard plate 121 and the second guard plate 121', and smaller diameter portion (i.e., a stepped down shoulder portion), for example, in the area of one or both of the first handle plate 131 and the second handle plate 131'.

Thus, when the folding knife 100 is assembled, the blade 100 is pivotably coupled, via the pivot pin 150, between the first guard plate 121 and the second guard plate 121' of the guard 120, and the guard 120 is pivotably coupled, via the pivot pin 150, between the first handle plate 131 and the second handle plate 131' of the handle 130. In this assembled relationship, with the tang pin 118 positioned within the aligned blade tang pin aperture 116, arcuate guard slots 124 and 124', and arcuate handle slots 134 and 134', the blade 110 is able to rotate, in relation to the guard 120 and the handle 130, within a limited arc of motion as defined by the interaction of the tang pin 118 and the arcuate slots 124, 124', 134, and 134'. Likewise, the guard 120 is able to rotate, in relation to the blade 110 and the handle 130, within a limited arc of motion as defined by the interaction of the tang pin 118 and the arcuate slots 124, 124', 134, and 134'.

Figure 6A:
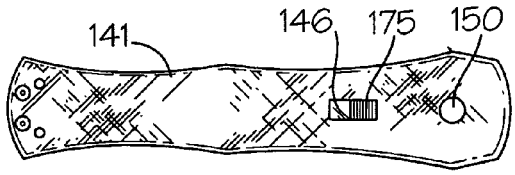
FIG. 6A shows a side view of the first exemplary embodiment of the folding knife according to this invention, illustrating the knife in the closed position with the optional lock means engaged.
Figure 6B:
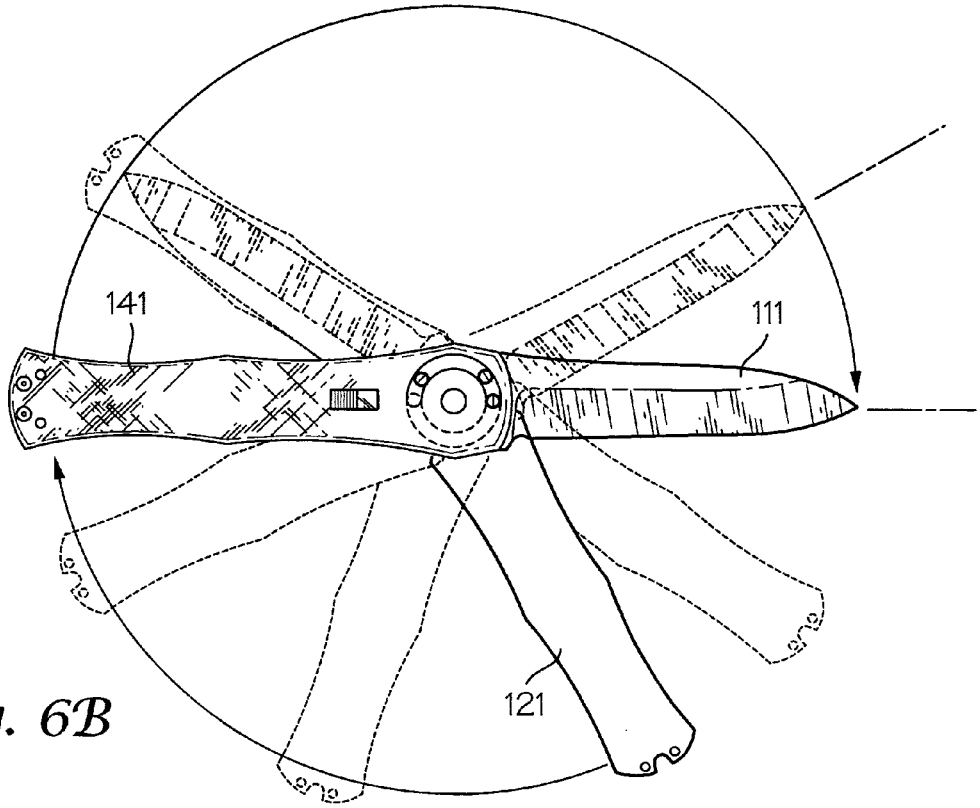
FIG. 6B shows a side view of the first exemplary embodiment of the folding knife according to this invention, illustrating the optional clock means disengaged and the components of the knife as the knife moves through an opening sequence.
Figure 6C:
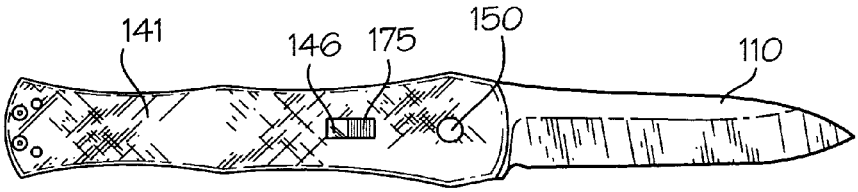
FIG. 6C shows a side view of the first exemplary embodiment of the folding knife according to this invention, illustrating the knife in the opened position with the optional lock means engaged.

In various exemplary embodiments, the arcuate guard slots 124 and 124' are formed so as to limit the arc of motion of the guard 120 such that the guard 120 is capable of rotating between a position wherein a longitudinal axis of the guard 120 is aligned with a longitudinal axis of the blade 110 and the blade 110 is within the blade storage area of the guard 120 (as illustrated in FIGS. 3B and 7A-7C) and a position wherein the longitudinal axis of the guard 120 is aligned with the longitudinal axis of the blade 110 and the blade 110 is outside of the blade storage area of the guard 120 (as illustrated in FIGS. 1, 6C, and 7F). In various exemplary embodiments, the arc of motion of the guard 120 is 180°, as measured between the longitudinal axis of the guard 120 and the longitudinal axis of the blade 110.

Likewise, in various exemplary embodiments, the arcuate handle slots 134 and 134' are formed so as to limit the arc of motion of the blade 110 such that the blade 110 is capable of rotating between a position wherein a longitudinal axis of the handle 130 is aligned with a longitudinal axis of the blade 110 and the blade 110 is within the guard storage area of the handle (as illustrated in FIGS. 6A and 7A) and a position wherein the longitudinal axis of the handle 130 is aligned with the longitudinal axis of the blade 110 and the blade 110 is outside of the guard storage area of the handle 130 (as illustrated in FIGS. 1, 6C, and 7D-7F). In various exemplary embodiments, the arc of motion of the blade 110 is 180°, as measured between the longitudinal axis of the handle 130 and the longitudinal axis of the blade 110.

In various exemplary embodiments, the extreme, or terminal ends of the arcuate guard slots 124, 124', 134, and 134' are reinforced so as not to be worn away or deformed, over time, by the interaction of the tang pin 118 and the terminal ends of the arcuate guard slots 124, 124', 134, and 134'.

In various exemplary embodiments, one or more washers 160 are included between adjacent sides of the handle 130, the guard 120, and the blade 110 to maintain the handle 130, the guard 120, and the blade 110 in an appropriately spaced apart relationship. In various exemplary embodiments, the washers 160 may also reduce the amount of friction between the handle 130, the guard 120, and the blade 110 during the opening and closing sequences.

Alternatively, one or more bosses or raised surfaces (not shown) are included on the mating surfaces of the handle 130, the guard 120, and the blade 110 to maintain the handle 130, the guard 120, and the blade 110 in an appropriately spaced apart relationship. In various exemplary embodiments, the bosses or raised surfaces (not shown) may also reduce the amount of friction between the handle 130, the guard 120, and the blade 110 during the opening and closing sequences.

As further illustrated in FIG. 2, the folding knife 100 includes an optional lock means 170. In various exemplary, non-limiting embodiments, the optional lock means 170 includes at least some of a first shuttle bar 171 coupled, via a lock bar 172, to a second shuttle bar 171'. The first shuttle bar 171 and the second shuttle bar 171' are coupled together, proximate a free end of the first shuttle bar 171 and the second shuttle bar 171', via the lock bar 172, to form the generally "U" shaped locking means 170. In various exemplary embodiments, the locking means 170 may be formed as one continuous component, wherein the first shuttle bar 171, the lock bar 172, and the second shuttle bar 171' are formed as one unit or component.

When the first shuttle bar 171 and the second shuttle bar 171' are coupled together, if necessary, the first shuttle bar 171 and the second shuttle bar 171' are substantially parallel and spaced apart to slidably overlap the handle 130 and allow the lock bar 172 to travel within the handle lock bar key ways 139 and 139'. As shown herein, the handle lock bar key ways 139 and 139' are appropriately sized grooves formed in the free end of the handle 130. The handle lock bar key ways 139 and 139' are of a sufficient depth to allow the lock means 170 to slidably move from an outer, or unlocked, position (designated "U" in FIG. 5) to an inner, or locked, position (designated "L" in FIG. 5).

In various exemplary embodiments, the lock means 170 includes the lock bar 172 and only one of the first shuttle bar 171 or the second shuttle bar 171'. Thus, the lock means 170 may comprise a substantially "L" shaped piece with the lock bar 172 project from one side.

Additionally, the lock bar 172 may be formed of a substantially round bar, as illustrated herein, or may comprise a substantially triangular bar, which is capable of engaging substantially "V" shaped handle lock bar key ways 139 and 139' and guard lock bar seats 129 and 129'.

In various exemplary embodiments, particularly if the lock means is spring biased to the closed position, the lock bar 172 would automatically lock the guard 120 when the guard 120 is in the opened or the closed position.

As also shown herein, and guard lock bar seats 129 and 129' are appropriately sized grooves formed in the free end of the guard 120. The guard lock bar seats 129 and 129' are of a sufficient depth to allow the lock means 170 to be captured within, or engage, the guard lock bar seats 129 and 129' when the lock means 170 is in the inner, or locked, position, and allow the lock means 170 to be free from, or disengage, the guard lock bar seats 129 and 129' when the lock means 170 is in the outer, or unlocked, position.

In various exemplary embodiments, the lock means 170 is maintained in the slidably overlapping position with the handle 130 by a shuttle channel (not shown) formed in handle scale 141 and a shuttle channel 147' formed in handle scale 141'.

The lock means 170 further includes at least one finger button 175 and/or 175' form of bar attached to the first shuttle bar 171 and/or the second shuttle bar 171', respectively. The finger buttons 175 and 175' extend through finger button apertures 146 and 146' formed in the handle scales 141 and 141', respectively, such that the lock means 170 may be manipulated by a user, via the finger buttons 175 and/or 175'.

Thus, when the handle 130 and the guard 120 are aligned, whether the folding knife 100 is in the closed position, as illustrated in FIG. 6A or the opened position, as illustrated in FIG. 6C, the lock means 170 may be engaged to lock the guard 120 in position within the handle 130, thereby locking the folding knife 100 and either the closed or the opened position.

In various exemplary embodiments, the lock means 170 is maintained in either the lock or unlock position by means of a friction fit between the lock means 170 and the handle 130 or the handle scales 141 and/or 141'. Alternatively, the lock means 170 may be maintained in the locked or unlocked position by means of corresponding mating surfaces, such as, for example, a corresponding protrusion and detent, a ball and detent, or a spring biasing device.

In various exemplary embodiments, the lock means 170 may comprise a spring detent, one or more magnets, or other similar device.

Figure 5:
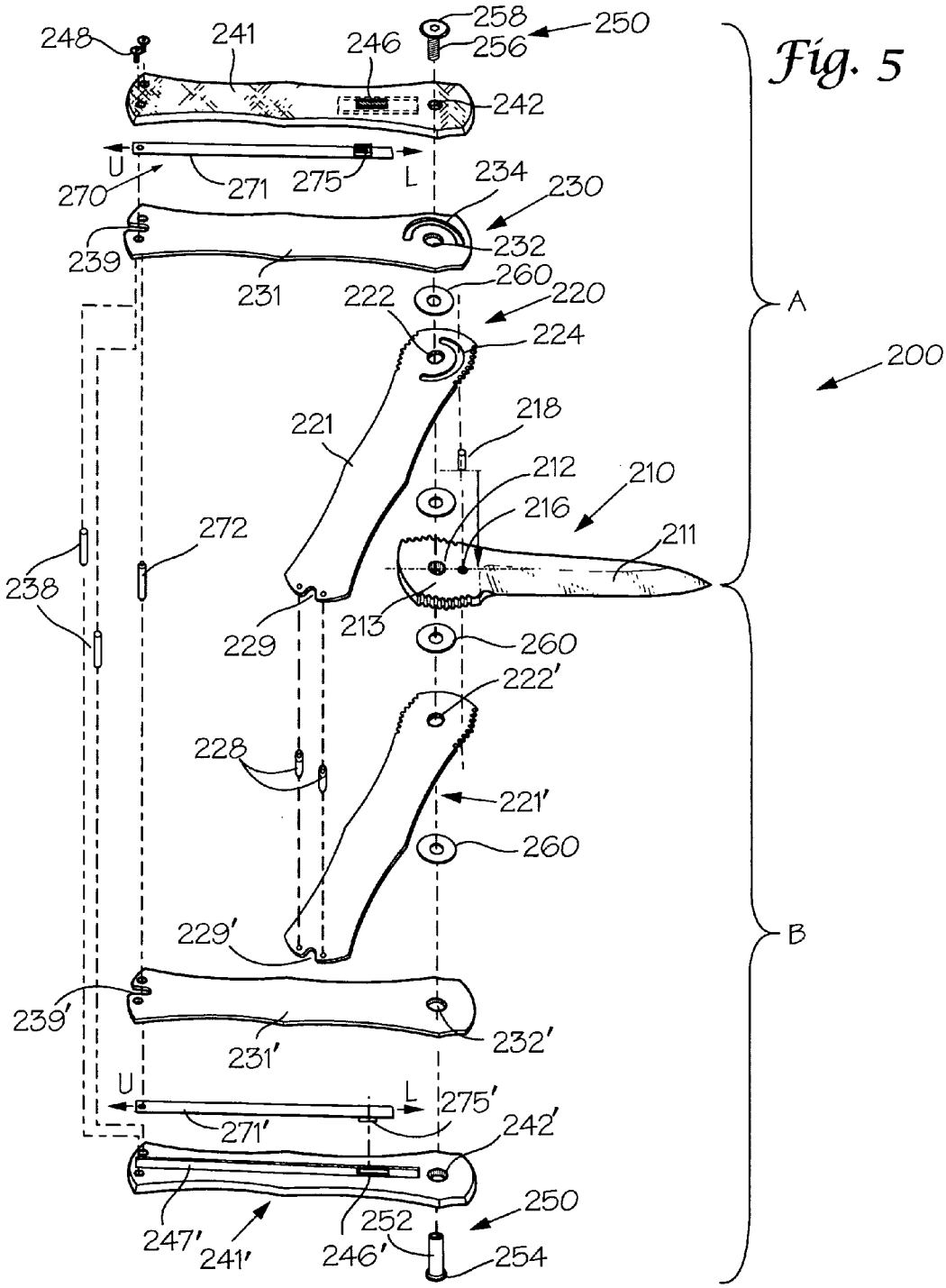
FIG. 5 shows an exploded perspective view of a second exemplary embodiment of the folding knife according to this invention.

FIG. 5 shows an exploded perspective view of a second exemplary embodiment of the folding knife according to this invention. As shown in FIG. 5, the folding knife 200 comprises at least some of a blade 200 comprising a sharpened portion 211, a blade pivot pin aperture 212, a tang portion 213, and a blade tang pin aperture 216; a tang pin 218; a guard 220 comprising a first guard plate 221 having a guard pivot pin aperture 22, an arcuate guard slot 224, and optionally a guard lock bar seat 229 coupled, via a guard coupling means 228, to a second guard plate 221' having a guard pivot pin aperture 222' and optionally a guard lock bar seat 229'; a handle 230 comprising a first handle plate 231 having a handle pivot pin aperture 232, an arcuate handle slot 234, and optionally a handle lock bar key way 239 coupled, via a handle coupling means 238, to a second handle plate 231' having a handle pivot pin aperture 232' and optionally a handle lock bar key way 239'; a first handle scale 241 having a first scale pivot pin aperture 242, and optionally a finger button aperture 246 and a shuttle channel (not shown); a second handle scale 241' having a second scale pivot pin aperture 242', and optionally a finger button aperture 246' and a shuttle channel 247 ' the first and second handle scales 241 and 241' being attached, coupled or joined to the handle plates 231 and 231', via, for example, scale attachment means 248"; a pivot pin 250 comprising an internally threaded sleeve portion 252 having an enlarged head portion 254 and an externally threaded bolt portion 256 having an enlarged head portion 258; one or more optional washers 260; and optional lock means 270 comprising a first shuttle bar 271 having an optional finger button 275, coupled, via a lock bar 272, to a second shuttle bar 271' having an optional finger button 275'.

It should be understood that each of these elements, if included, correspond to and operate similarly to the blade 110, the sharpened portion 111, the blade pivot pin aperture 112, the tang portion 113, the blade tang pin aperture 116, the tang pin 118, the guard 120, the first guard plate 121, the guard pivot pin aperture 122, the arcuate guard slot 124, the optional guard lock bar seat 129, the guard coupling means 128, the second guard plate 121', the guard pivot pin aperture 122', the optional guard lock bar seat 129', the handle 130, the first handle plate 131, the handle pivot pin aperture 132, the arcuate handle slot 134, the optional handle lock bar key way 139, the handle coupling means 138, the second handle plate 131', the handle pivot pin aperture 132', the optional handle lock bar key way 139', the first handle scale 141, the first scale pivot pin aperture 142, the optional finger button aperture 146 and the shuttle channel (not shown), the second handle scale 141', the second scale pivot pin aperture 142', the optional finger button aperture 146' and the shuttle channel 147', the pivot pin 150, the internally threaded sleeve portion 152 having the enlarged head portion 154, the externally threaded bolt portion 156 having the enlarged head portion 158, the one or more optional washers 160, the optional lock means 170, the first shuttle bar 171, the optional finger button 175, the lock bar 172, the second shuttle bar 171', and the optional finger button 175', as described above with reference to FIGS. 1-4.

However, as shown in FIG. 5, the second guard plate 221' does not include an arcuate guard slot, the second handle plate 131' does not include an arcuate handle slot, and the tang pin 218 is approximately half the length of the tang pin 118. Thus, as illustrated in FIG. 5, when the folding knife 200 is assembled, the tang pin 218 is positioned within the aligned blade tang pin aperture 216, the arcuate guard slot 224, and the arcuate handle slot 234. In this manner, the blade 210 is able to rotate, in relation to the guard 220 and the handle 230, within a limited arc of motion as defined by the interaction of the tang pin 218 and the guard slots 224 and 234. Likewise, the guard 220 is able to rotate, in relation to the blade 210 and the handle 230, within a limited arc of motion as defined by the interaction of the tang pin 218 and the arcuate slot 224 and 234.

While FIG. 5 shows the second guard plate 221' without an arcuate guard slot and the second handle plate 131' without an arcuate handle slot, it should be appreciated that the arcuate guard slot and the arcuate handle slot may be for removed from either the first guard plate 221 and the first handle plate 131 or the second guard plate 221' and the second handle plate 131'.

FIGS. 6A through 6C show side views of the folding knife 100, illustrating the knife 100 in the closed position, as the knife 100 moves through an opening sequence, and in the opened position. FIGS. 7A through 7F show partially-cutaway side views of the folding knife 100, illustrating certain components of the knife in the closed position, in a first exemplary position in the opening sequence, a second exemplary position in the opening sequence, a third exemplary position in the opening sequence, a fourth exemplary position in the opening sequence, and the opened position.

It should be understood that while the folding knife illustrated in FIGS. 6A-7F is primarily shown and described as including the features of the folding knife 100, the folding knife illustrated in FIGS. 6A-7F may incorporate any of the features or elements of the folding knife 100 or the folding knife 200.

As illustrated in FIGS. 6A-7F, the folding knife 100 is assembled as described above. In the closed position, as illustrated in FIGS. 6A and 7A, the guard 120 and blade 110 are nested within the handle 130. When in the closed position, the tang pin 118 is essentially trapped between the blade tang pin aperture 116, terminal ends of the arcuate guard slots 124 and 124', and terminal ends of the arcuate handle slots 134 and 134. Thus, so long as the folding knife 100, and more particularly the guard 120 is maintained in the closed position, by either the user maintaining an encircling grip on the folding knife 100 or maintaining the lock means 170 (if included) in a locked position, the blade 110 is secured within the guard 120 and the handle 130.

To open the folding knife 100, as illustrated in FIGS. 6B and 7B-7C, the lock means (if included) is unlocked, and the guard 120 and blade 110 are rotated together, via the pivot pin 150, out of the handle 130. In various exemplary embodiments, the weight of the blade 110 is greater than the weight of the guard 120. Thus, opening of the folding knife 100 may be initiated by rotating the folding knife 100 in the direction of the pivot end and then stopping the rotation of the folding knife (i.e., by a flick of the wrist). Because of the weight of the knife blade 110, when the rotation of the folding knife 100 is stopped, the momentum of the blade 110 continues to pivot the blade 110, about the pivot pin 150, towards the open position.

As the blade 110 pivots towards the open position, the tang pin 118 travels within the arcuate handle slots 134 and 134', while continuing to engage a terminal end of the arcuate guard slots 124 and 124'. So long as the tang pin 118 engages a terminal end of the arcuate guard slots 124 and 124', the guard 120 rotates with the blade 110. Thus, the blade 110 and the guard 120 generally rotate together, as the tang pin 118 travels along the arcuate handle slots 134 and 134', until the tang pin 118 is rotated into contact with a terminal end of the arcuate handle slots 134 and 134'.

As illustrated in FIGS. 6B and 7D-7E, after the blade 100 rotates approximately 180°, the tang pin 118 is rotated into contact with a terminal end of the arcuate handle slots 134 and 134', rotation of the blade 110, about the pivot pin 150, is stopped. When rotation of the blade 110 is stopped, rotation of the guard 120 continues as the stationary tang pin 118 continues to interact with the arcuate guard slots 124 and 124'.

As illustrated in FIGS. 6C and 7F, rotation of the guard 120 continues until a terminal end of the arcuate guard slots 124 and 124' is rotated into contact with the stationary tang pin 118. When the terminal end of the arcuate guard slots 124 and 124' is rotated into contact with the stationary tang pin 118, rotation of the guard 120 is stopped and the folding knife 100 is in the opened position. When the folding knife 100 is in the opened position, the guard 120 is nested substantially inside the handle 130 and the tang pin 118 is essentially trapped between the blade tang pin aperture 116, terminal ends of the arcuate guard slots 124 and 124', and terminal ends of the arcuate handle slots 134 and 134'.

So long as the folding knife 100, and more particularly the guard 120, is maintained in the opened position, by either the user maintaining a grip on the handle 130 or maintaining the lock means 170 (if included) in a locked position, the blade 110 is secured in the opened position. Thus, when the folding knife 100 is in the opened position and is grasped in a normal, working manner, the blade 110 cannot be closed on the user's fingers.

It should be understood that reversing this process closes both the guard 120 and the blade 110 safely within the handle 130.

While this invention has been described in conjunction with the exemplary embodiments outlined above, it is evident that many alternatives, modifications, and variations will be apparent to those skilled in the art.

For example, while the folding knife has been shown as having a particular overall appearance, it should be appreciated that the elements of the folding knife may be employed in a folding knife having a different overall appearance. Furthermore, it should also be appreciated that the knife blade 110 or 210 may be replaced by another instrument, implement, or tool, such as, for example, screwdriver, a pen, pencil, or other marking device, one or more keys, a saw blade, or any other instrument, implement, or tool. In these embodiments, the overall shape and size of the guard 120 or 220 and the handle 130 or 230 may be altered to accommodate the instrument, implement, or tool, while still employing the design factors and operating principles of this invention.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A folding knife, comprising:

a blade, wherein the blade comprises a sharpened portion and a tang portion, wherein the tang portion includes a blade pivot pin aperture that is capable of receiving a portion of a pivot pin such that the blade is capable of rotating about the pivot pin;

a tang pin extending from at least one side of the tang portion of the blade;

a guard having a pivot end and a free end, wherein the guard comprises a first guard plate and a second guard plate, wherein the first guard plate and the second guard plate are substantially parallel and spaced apart to define a blade storage area between the first guard plate and the second guard plate, wherein the first guard plate includes a first guard pivot plate pin aperture that is capable of receiving a portion of the pivot pin and the second guard plate includes a second guard plate pivot pin aperture that is capable of receiving a portion of the pivot pin such that the guard is capable of rotating about the pivot pin, wherein the first guard plate includes an arcuate guard slot formed concentric to the first guard pivot plate pin aperture, such that the tang pin is capable of engaging the arcuate guard slot and limiting an arc of motion of the guard as defined by the interaction of the tang pin and terminal ends of the guard slot;

a handle having a pivot end and a free end, wherein the handle comprises a first handle plate and a second handle plate, wherein the first handle plate and the second handle plate are substantially parallel and spaced apart to define a guard storage area between the first handle plate and the second handle plate, wherein the first handle plate includes a first handle pivot plate pin aperture that is capable of receiving a portion of the pivot pin and the second handle plate includes a second handle plate pivot pin aperture that is capable of receiving a portion of the pivot pin such that the handle is capable of rotating about the pivot pin, wherein the first handle plate includes an arcuate handle slot formed concentric to the first handle pivot plate pin aperture, such that the tang pin is capable of engaging the arcuate handle slot and limiting an arc of motion of the blade as defined by the interaction of the tang pin and terminal ends of the handle slot;

a first handle scale having a first handle scale pivot pin aperture, wherein the first handle scale is coupled in overlying relationship with an outer surface of the first handle plate, and wherein the first handle scale pivot pin aperture is capable of receiving at least a portion of the pivot pin;

a second handle scale having a second handle scale pivot pin aperture, wherein the second handle scale is coupled in overyling relationship with an outer surface of the second handle plate, and wherein the second handle scale includes a second scale pivot pin aperture that is capable of receiving at least a portion of the pivot pin; and a pivot pin, wherein the pivot pin extends through the first handle scale pivot pin aperture, the first handle pivot plate pin aperture, the first guard pivot plate pin aperture, the blade pivot pin aperture, the second guard pivot plate pin aperture, the second handle pivot plate pin aperture, and the second handle scale pivot pin aperture, such that the guard and the blade are capable of rotating in relation to the handle.

2. The knife of claim 1, wherein the tang pin extends from a blade tang pin aperture formed in the tang portion of the blade.

3. The knife of claim 1, wherein the blade storage area is appropriately sized to allow at least the sharpened portion of the blade to be pivoted into and/or out of the blade storage area.

4. The knife of claim 1, wherein the first guard plate and the second guard plate are maintained in a substantially parallel and spaced apart relationship, via a guard coupling means proximate a free end of the first guard plate and the second guard plate, to form the generally "U" shaped guard.

5. The knife of claim 1, wherein the guard storage area is appropriately sized to allow the guard to be pivoted into and/or out of the guard storage area.

6. The knife of claim 1, wherein the first handle plate and the second handle plate are maintained in a substantially parallel and spaced apart relationship, via a handle coupling means proximate a free end of the first handle plate and the second handle plate, to form the generally "U" shaped handle.

7. The knife of claim 1, wherein the arcuate guard slot is formed so as to limit the arc of motion of the guard such that the guard is capable of rotating between a position wherein a longitudinal axis of the guard is aligned with a longitudinal axis of the blade and the blade is within the blade storage area of the guard and a position wherein the longitudinal axis of the guard is aligned with the longitudinal axis of the blade and the blade is outside of the blade storage area of the guard.

8. The knife of claim 1, wherein the arc of motion of the guard is 180°, as measured between the longitudinal axis of the guard and the longitudinal axis of the blade.

9. The knife of claim 1, wherein the arcuate handle slot is formed so as to limit the arc of motion of the blade such that the blade is capable of rotating between a position wherein a longitudinal axis of the handle is aligned with a longitudinal axis of the blade and the blade is within the guard storage area of the handle and a position wherein the longitudinal axis of the handle is aligned with the longitudinal axis of the blade and the blade is outside of the guard storage area of the handle.

10. The knife of claim 1, wherein the arc of motion of the blade is 180°, as measured between the longitudinal axis of the handle and the longitudinal axis of the blade.

11. The knife of claim 1, wherein the arcuate handle slot in the first handle plate does not pass completely through the first handle plate.

12. The knife of claim 1, wherein the pivot pin comprises an internally threaded sleeve portion having an enlarged head portion and an externally threaded bolt portion having an enlarged head portion.

13. The knife of claim 1, wherein one or more washers are included between adjacent sides of the handle, the guard, and the blade.

14. The knife of claim 1, wherein at least a portion of the tang pin extends from both sides of the tang portion of the blade and wherein the second guard plate includes an arcuate guard slot formed concentric to the second guard plate pivot pin aperture, wherein the arcuate guard slot formed in the second guard plate is identical to the arcuate guard slot formed in the first guard plate, such that a portion of the tang pin is capable of engaging the arcuate guard slot and limiting an arc of motion of the guard as defined by the interaction of the tang pin and terminal ends of the guard slots.

15. The knife of claim 1, wherein the tang pin extends from both sides of the tang portion of the blade, wherein the second guard plate includes an arcuate guard slot formed concentric to the second guard plate pivot pin aperture, wherein the arcuate guard slot formed in the second guard plate is identical to the arcuate guard slot formed in the first guard plate, wherein the second handle plate includes an arcuate handle slot formed concentric to the second handle pivot plate pin aperture, wherein the arcuate handle slot formed in the second handle plate is identical to the arcuate handle slot formed in the first handle plate, such that the tang pin is capable of engaging the arcuate guard slots in the first guard plate and the second guard plate and the arcuate handle slots in the first handle plate and the second handle plate so as to limit an arc motion of the guard as defined by the interaction of the tang pin and terminal ends of the guard slots.

16. The knife of claim 15, wherein the arcuate handle slot in the first handle plate does not pass completely through the first handle plate and the arcuate handle slot in the second handle plate does not pass completely through the second handle plate.

17. The knife of claim 1, further including an lock, wherein the lock comprises a first shuttle bar, wherein the first shuttle bar is coupled to a lock bar, to form the generally "L" shaped lock, such taht the lock is able to slidably overlap an outer surface of the handle, such that the lock bar is capable of traveling within at least one handle lock bar key way formed in the free end of the handle and at least one guard lock bar seat formed in the free end of the guard.

18. The knife of claim 1, further including an lock wherein the lock comprises a first shuttle bar and a second shuttle bar, wherein the first shuttle bar and the second shuttle bar are coupled in a substantially parallel and spaced apart relationship, via a lock bar, to form the generally "U" shaped lock, such that the lock is able to slidably overlap the outer surfaces of the handle, such that the lock bar is capable of traveling within handle lock bar key ways formed in the free end of the handle and guard lock bar seats formed in the free end of the guards.

19. The knife of claim 17, wherein the first shuttle bar includes a finger button portion that protrudes at least partially through a finger button aperture formed in the first handle scale.

20. The knife of claim 18, wherein at least one of the first shuttle bar and the second shuttle bar includes a finger button portion that protrudes at least partially through a finger button aperture formed in the first handle scale and the second handle scale.

21. A folding knife, comprising:

a blade, wherein the blade comprises a sharpened portion and a tang portion, wherein the tang portion includes a blade pivot pin aperture that is capable of receiving a portion of a pivot pin such that the blade is capable of rotating about the pivot pin;

a tang pin extending from at least one side of the tang portion of the blade;

a guard having a pivot end and a free end, wherein the guard comprises a first guard plate and a second guard plate, wherein the first guard plate and the second guard plate are substantially parallel and spaced apart to define a blade storage area between the first guard plate and the second guard plate, wherein the first guard plate includes a first guard pivot plate pin aperture that is capable of receiving a portion of the pivot pin and the second guard plate includes a second guard plate pivot pin aperture that is capable of receiving a portion of the pivot pin such that the guard is capable of rotating about the pivot pin, wherein the first guard plate includes an arcuate guard slot formed concentric to the first guard pivot plate pin aperture, such that the tang pin is capable of engaging the arcuate guard slot and limiting an arc of motion of the guard as defined by the interaction of the tang pin and terminal ends of the guard slot;

a handle having a pivot end and a free end, wherein the handle comprises a first handle plate and a second handle plate, wherein the first handle plate and the second handle plate are substantially parallel and spaced apart to define a guard storage area between the first handle plate and the second handle plate, wherein the first handle plate includes a first handle pivot plate pin aperture that is capable of receiving a portion of the pivot pin and the second handle plate includes a second handle plate pivot pin aperture that is capable of receiving a portion of the pivot pin such that the handle is capable of rotating about the pivot pin, wherein the first handle plate includes an arcuate handle slot formed concentric to the first handle pivot plate pin aperture and formed so as to extend only partially into the first handle plate such that the tang pin cannot pass through the arcuate handle slot, such that the tang pin is capable of engaging the arcuate handle slot and limiting an arc of motion of the blade as defined by the interaction of the tang pin and terminal ends of the handle slot; and a pivot pin, wherein the pivot pin extends through the first handle pivot plate pin aperture, the first guard pivot plate pin aperture, the blade pivot pin aperture, the second guard pivot plate pin aperture, and the second handle pivot plate pin aperture, such that the guard and the blade are capable of rotating in relation to the handle.

22. A folding implement, comprising:

a tool portion, wherein the tool portion comprises a working portion and a tang portion, wherein the tang portion includes a tool portion pivot pin aperture that is capable of receiving a portion of a pivot pin such that the tool portion is capable of rotating about the pivot pin;

a tang pin extending from at least one side of the tang portion of the tool portion;

a guard having a pivot end and a free end, wherein the guard comprises a first guard plate and a second guard plate, wherein the first guard plate and the second guard plate are substantially parallel and spaced apart to define a tool portion storage area between the first guard plate and the second guard plate, wherein the first guard plate includes a first guard pivot plate pin aperture that is capable of receiving a portion of the pivot pin and the second guard plate includes a second guard plate pivot pin aperture that is capable of receiving a portion of the pivot pin such that the guard is capable of rotating about the pivot pin, wherein the first guard plate includes an arcuate guard slot formed concentric to the first guard pivot plate pin aperture, such that the tang pin is capable of engaging the arcuate guard slot and limiting an arc of motion of the guard as defined by the interaction of the tang pin and terminal ends of the guard slot;

a handle having a pivot end and a free end, wherein the handle comprises a first handle plate and a second handle plate, wherein the first handle plate and the second handle plate are substantially parallel and spaced apart to define a guard storage area between the first handle plate and the second handle plate, wherein the first handle plate includes a first handle pivot plate pin aperture that is capable of receiving a portion of the pivot pin and the second handle plate includes a second handle plate pivot pin aperture that is capable of receiving a portion of the pivot pin such that the handle is capable of rotating about the pivot pin, wherein the first handle plate includes an arcuate handle slot formed concentric to the first handle pivot plate pin aperture, such that the tang pin is capable of engaging the arcuate handle slot and limiting an arc of motion of the tool portion as defined by the interaction of the tang pin and terminal ends of the handle slot;

a first handle scale having a first handle scale pivot pin aperture, wherein the first handle scale is coupled in overlying relationship with an outer surface of the first handle plate, and wherein the first handle scale pivot pin aperture is capable of receiving at least a portion of the pivot pin;

a second handle scale having a second handle scale pivot pin aperture, wherein the second handle scale is coupled in overlying relationship with an outer surface of the second handle plate, and wherein the second handle scale includes a second scale pivot pin aperture that is capable of receiving at least a portion of the pivot pin; and a pivot pin, wherein the pivot pin extends through the first handle scale pivot pin aperture, the first handle pivot plate pin aperture, the first guard pivot plate pin aperture, the tool portion pivot pin aperture, the second guard pivot plate pin aperture, the second handle pivot plate pin aperture, and the second handle scale pivot pin aperture, such that the guard and the tool portion are capable of rotating in relation to the handle.

* * * * *